US007421955B2

(12) United States Patent
Lisenby

(10) Patent No.: US 7,421,955 B2
(45) Date of Patent: Sep. 9, 2008

(54) HAZARDOUS MATERIAL TRANSPORTATION RAILCAR AND CASK CRADDLE

(75) Inventor: John Dave Lisenby, Dothan, AL (US)

(73) Assignee: Private Fuel Storage, LaCrosse, WI (US)

( * ) Notice: Subject to any disclaimer, the term of this patent is extended or adjusted under 35 U.S.C. 154(b) by 223 days.

(21) Appl. No.: 11/226,459

(22) Filed: Sep. 15, 2005

(65) Prior Publication Data

US 2008/0145170 A1 Jun. 19, 2008

(51) Int. Cl.
*B61D 5/00* (2006.01)

(52) U.S. Cl. ..... 105/362; 410/49; 410/77

(58) Field of Classification Search ..... 105/355, 105/362; 248/146, 154; 410/36, 42, 47, 410/49, 77, 87, 88
See application file for complete search history.

(56) References Cited

U.S. PATENT DOCUMENTS 2,334,335 A * 11/1943 Lathrop ..... 410/42
5,044,846 A * 9/1991 Richardson ..... 410/47
6,280,127 B1 * 8/2001 Spilker et al. ..... 410/88
6,896,457 B2 * 5/2005 Halliar ..... 410/77
2005/0063795 A1 * 3/2005 Jagos et al. ..... 410/49

* cited by examiner

*Primary Examiner*—Lars A. Olson
(74) *Attorney, Agent, or Firm*—Hogan & Hartson LLP

(57) ABSTRACT

The invention provides an apparatus for safely transporting various hazardous materials, including spent nuclear fuel. The invention includes a cask cradle that is configured to securely receive a cask for containment of hazardous materials, such as spent nuclear fuel. The cask cradle in accordance with the invention includes a front cradle section load bearing brace, a rear cradle section having a first non-loading bearing brace and a second non-loading brace, first and second horizontal support members connecting the front cradle section to the rear cradle section and trunnions that lock into and retain the cask. The invention also provides a railcar having a depressed flatbed region for receiving and securely retaining the cask cradle. The railcar also includes a variety of sensors that monitor various aspects of the railcar performance, including braking performance sensors, sensors for truck hunting, rocking and vertical, lateral and longitudinal acceleration, a Global Positioning Satellite (GPS) sensor and wheel bearing sensors corresponding to each of the wheel bearing assemblies.

21 Claims, 6 Drawing Sheets

HAZARDOUS MATERIAL TRANSPORTATION RAILCAR AND CASK CRADDLE

BACKGROUND OF THE INVENTION

1. Field of the Invention

The invention relates to an apparatus for safely transporting spent nuclear fuel and other hazardous materials and, more particularly, to a rail transportation system for safely transporting spent nuclear fuel and other hazardous waste materials to interim storage facilities, transfer points, or to a final federal disposal site, the rail transportation system including a railcar and cask cradle.

2. Description of the Related Art

Nuclear reactors and storage sites for radioactive materials have been in operation for many years. In a nuclear reactor, the fissionable material gradually becomes spent and must be removed along with other radioactive byproducts. Since the spent fuel contains fission by products which are highly radioactive and which generate large amounts of heat, the spent fuel is usually temporarily stored in the reactor's spent fuel pool. The spent fuel pool is a pool of water of sufficient volume to prevent the escape of harmful radiation and to absorb and dissipate the heat generated by the decaying fissionable material. Alternatively, the spent fuel may be temporarily stored in a hot cell. A hot cell refers to a heavily shielded structure having the capability to prevent the escape of harmful radiation, while absorbing and dissipating the heat generated by the spent fuel.

Generally, there is limited storage space in a nuclear reactor's spent fuel pool or in its hot cell. Thus, the spent fuel must be moved to a storage site to make room for additional spent fuel. In some cases, there is a desire to shut the nuclear reactor down and remove all fissionable material, in which case, all of the fissionable material must be removed to a storage site. Conventionally, spent nuclear fuel has been stored at various locations across the country. Spent nuclear fuel has been transported by storing it in small groups using multiple fuel storage drums. The spent fuel may be transported in the form of spent fuel rods or in the form of rubble. Conventionally, spent fuel rod assemblies have been transported in fuel transportation containers designed for undamaged fuel rod assemblies. The foregoing attempted solution, however, has required that substantially fewer failed fuel rod assemblies be transported per container, compared to the number of undamaged fuel rod assemblies that can be transported in the same container. By transporting fewer failed fuel rod assemblies, even if some fissionable material escapes from the failed fuel rods and accumulates near other fissionable material in the container, there is not enough fissionable material in the entire container to pose a significant risk of criticality. The problem with the foregoing solution, though, is it wasteful of resources, because significantly fewer failed fuel rod assemblies can be transported per container relative to the number of undamaged fuel rod assemblies that can be transported in the same container.

Another, attempted solution has been to transport failed fuel rod assemblies in fuel transportation containers designed for transporting fissionable material in the form of rubble. That is, the fissionable material is not in the form of rods, but is in the form of small particles. Thus, the failed fuel rods are broken up into rubble, and placed in the container. The problem with this solution, however, is that the method is inefficient for three principle reasons. First, the failed fuel rod assemblies be broken up. Second, such containers are capable only of transporting comparatively few failed fuel rod assemblies. Finally, the transportation container is only designed for transportation, not storage. Thus, once the fissionable material has been transported to another location, the container must be unloaded in a fuel pool or in a hot cell, and other arrangements made to store the fissionable material.

The other major problem with transporting spent nuclear fuel is that United States law imposes stringent safety requirements even on containers used to transport undamaged fuel rod assemblies. The relevant law imposes significantly more restrictive requirements with respect to the transportation of spent nuclear fuel across areas accessible to the public, as opposed to areas inaccessible to the public.

State of the art spent fuel transportation containers for areas accessible to the public are casks with individual compartments. The fuel rod assemblies are loaded into individual compartments in the casks in a spent fuel pool or a hot cell. The purpose of the individual compartments within each cask is to ensure sufficient spacing between adjacent fuel rod assemblies to avoid any danger of criticality. The fuel rod assemblies are loaded into the cask in a spent fuel pool or hot cell. Upon reaching the storage location, the fuel rod assemblies must be removed from the cask in a spent fuel pool or hot cell, and then stored.

In contrast, state of the art spent fuel transportation containers for areas inaccessible to the public are typically a sealed canister placed within a cask. The fuel rod assemblies are loaded into individual compartments in a canister in a spent fuel pool or a hot cell. The canister is then sealed and placed in a cask. When the cask/canister assembly reaches the storage site, the canister is removed from the cask, stored, and the cask may be reused, which is a much more efficient process.

Nonetheless, the cask/canister method cannot be used for transportation in areas accessible to the public because they fail to meet the requirements imposed by U.S. law. Whether the spent fuel is transported by cask or a sealed canister within a cask, there is a significant need for the casks to be transported in a safe and efficient manner so as to eliminated the possibility of hazardous materials leaking into the environment. Accordingly, there is a need for an invention that provides for the transportation and storage of spent fuel rod assemblies, and for a cask/canister device for the transportation and storage of spent fuel across areas accessible to the public. The present invention provides a solution, wherein a existing casks can be used and can be safely transported resulting in much greater efficiency in the transportation over public thoroughfares and storage of spent nuclear fuel.

SUMMARY OF THE INVENTION

The invention provides an apparatus for safely transporting spent nuclear fuel and other hazardous materials via rail transport. The system in accordance with the invention includes a transportation cradle that is mountable onto a railcar. The cradle in accordance with the invention is configured so as to securely receive and hold a cask containing spent nuclear fuel or other hazardous materials. The railcar is specifically designed and tested to meet AAR requirements for the transportation of spent nuclear fuel.

The cradle in accordance with the invention includes the main structure of the cradle which supports the dead weight and dynamic loads from the transportation cask, restraining members which restrain the transportation cask from an upward movement as well as horizontal movements, and a rotational support member which allows the transportation cask to be placed in the vertical position onto the cradle and rotated to the horizontal position for final transportation. The main structure of the cradle supports both the weight of the cask as well as the dynamic loads that will be experienced during transportation of the cask. The restraining members are designed to provide adequate support to protect the cask including protection to the cask from the cradle allowing the cask to be exposed to loads in excess of the maximum cask design load (i.e., The restraining members will fail at a lower force than the maximum design force for the cask which will allow the impact absorbers located on the ends of the cask to prevent the cask from receiving a force greater than the design of the cask itself.). Thus, the cradle design provides support to protect the spent fuel transportation cask and also to protect the cask should it be exposed to loads that would exceed the design load for the cask. In accordance with the invention, the cradle will be secured to the railcar in four locations to accommodate the camber in the railcar flatbed. This will reduce potential failure of the cradle to railbed connection.

The railcar in accordance with the invention is designed with high structural safety margins in the railcar body and railcar trucks, high precision railcar trucks and brakes to assure performance safety and reliability, and a performance monitoring system to allow for early warning of potential structural or performance problems. The monitoring system in accordance with the invention provides early warning to the train crew of component or performance degradation to assure pro-active actions prior to failure. The railcar monitoring system in accordance with the invention includes the monitoring and recording of the following factors: railcar speed, truck movement, rocking, wheel flats, bearing conditions, braking performance, as well as vertical, lateral and longitudinal acceleration. By monitoring and recording each of these factors, the pro-active actions can be taken to prevent railcar and/or cradle failures that could increase the risk of damage to the spent nuclear fuel cask.

The cradle and railcar in accordance with the invention are designed together so as to provide a high level of assurance against structural failure of the railcar and cradle combination.

Thus, the invention provides transportation cask cradle that includes a front cradle section load bearing brace, the load bearing brace including a first and second opposing end portions, a rear cradle section having a first non-loading bearing brace and a second non-loading brace, the first non-load bearing brace having a first top section and the second non-load bearing brace having a second top section, the first and second top sections opposing each other, first and second horizontal support members connecting the front cradle section to the rear cradle section and a first trunnion disposed on the first top section of the first non-load bearing brace and a second trunnion disposed on the second top section of the second non-load bearing brace.

The invention also provides a nylon bearing surface affixed to load bearing brace as well as a stop bar affixed to the load bearing brace to prevent longitudinal movement of the cask.

The invention further includes a plurality of base members disposed on a bottom surface of the cradle, the base members allowing the transport cradle to be affixed to a vehicle surface.

The invention also provides an uplift prevention device affixed to the first top section of the first non-load bearing brace and the second top section of the second non-load bearing brace which prevents upward (vertical) movement of the cask.

The invention also provides a railcar for transporting hazardous materials that includes a depressed flatbed disposed on a planar surface of the railcar, at least one retaining bracket disposed on the depressed flat bed, the at least one retaining bracket configured so as to facilitate coupling with a transportation cradle, as described above. In accordance with the invention, the railcar may also include braking performance sensors dispose at each end of the railcar which gather data related braking of the railcar. In accordance with the invention, the railcar may also include sensors for truck hunting, rocking and vertical, lateral and longitudinal acceleration, whereby the sensors are disposed at a middle section of the railcar. In accordance with the invention, the railcar may also include a Global Positioning Satellite (GPS) sensor disposed at a front section of the railcar. In accordance with the invention, the railcar may also include a plurality of wheel bearing sensors corresponding to each of the wheel bearing assemblies.

BRIEF DESCRIPTION OF THE DRAWINGS

The accompanying drawings, which are included to provide a further understanding of the invention and are incorporated in and constitute a part of this specification, illustrate embodiments of the invention. Together with the written description, these drawings serve to explain the principles of the invention. In the drawings.

DETAILED DESCRIPTION OF THE PREFERRED EMBODIMENTS

Figure 1:
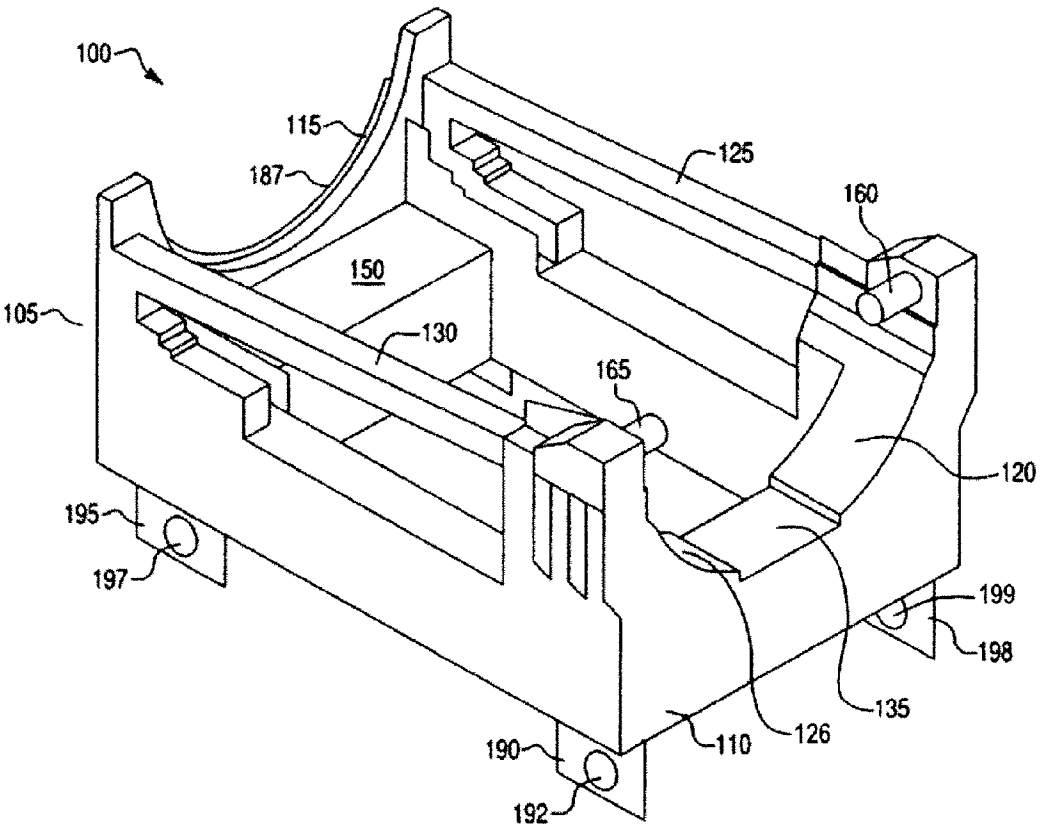
FIG. 1 illustrates a perspective view of a cradle for transporting spent nuclear fuel in accordance with an embodiment of the invention.

FIG. 1 shows a perspective view of a cradle 100 for transporting spent nuclear fuel or other hazardous materials in accordance with an embodiment of the invention. As will be described in greater detail below, the cradle 100 is configured to securely receive a spent fuel transportation cask (not shown in FIG. 1). FIG. 1 shows a front cradle section 105 and a rear cradle section 110. The front cradle section 105 is connected to the rear cradle section 110 via a first horizontal support 130 and a second horizontal support 125. The first horizontal support 130 and the second horizontal support 125 provide support and stability to the cradle 100. The front cradle section 105 includes a front load bearing brace 115. The front load bearing brace 115 has a semicircular shape to accommodate the shape of the transportation cask. The front load bearing brace 115 has a nylon bearing surface (not visible in FIG. 1) on its top surface that provides bearing surface for the cask. Thus, the nylon bearing surface is affixed or coated onto the surface of the front load bearing brace 115 that comes into contact with the transportation cask. The nylon coated front load bearing brace 115 provides a durable surface onto which the transportation cask can be placed. The rear cradle section 110 includes a first rear brace 120 and a second rear brace 126. The rear braces 120 and 126 are not load bearing and do not come into contact with the transportation cask, however, they do provide structural support for the cradle 100. As shown in FIG. 1, a second planar base 135 is disposed between the first and second rear braces 120 and 126. The second planer brace 135 provides additional structural support for the cradle but does not contact the transportation cask.

As shown in FIG. 1, a first planer base 150 is disposed adjacent the front load bearing brace 115. The first planar base also does not contact the transportation cask.

As shown in FIG. 1, the rear cradle section 110 also has a first trunnion 160 and a second trunnion 165 which face each other and project toward each other. The first trunnion 160 is located at a top end of the first rear brace 120 and the second trunnion 165 is located at a top end of the second rear brace 126. The trunnions 160 and 165 project inward with reference to the cradle 100 so that they can connect and lock into the transportation cask when it is mounted onto the cradle 100. The trunnions 160 and 165 are, thus, in contact with transportation cask and provide support for the rear of the transportation cask. The trunnions 160 and 165 provide openings which can 'catch' pocket trunnions which are located on the surface of the transportation cask and thus, hold the transportation cask in place. The trunnions 160 and 165 support the weight of the transportation cask and prevent upward movement of the rear portion of the transportation cask. When the transportation cask is first lowered onto the cradle 100, the trunnions 160 and 165 first receive the transportation cask and the cask when then rotated downward and 90° so that the front of the transportation cask rests on the nylon coated front load bearing brace 115 of the front section of the cradle 105.

FIG. 1 also shows base members 190, 195 and 198 located at the base of the cradle 100. The base members 190, 195 and 198 are located near the corners of the base of the cradle 100. A fourth base member is also present, but not clearly visible in FIG. 1. Each base member 190, 195 and 198 has corresponding lug 192, 197 and 199. The fourth base member that is not shown also has a lug. The lugs 192, 197 and 199, which are shaped like a dowel or pin, allow the cradle 100 to be mounted and affixed to the top surface of a railcar or other transport vehicle.

Thus, the cradle 100 is configured to receive a spent fuel transportation cask that can be lowered into the cradle 100. When placed into the cradle 100, the transportation cask is in contact with the cradle 100 at the bearing surfaces that coat the front load bearing brace 115 located at the front cradle section 110. The transportation cask is also in contact with the trunnions 160 and 165 on the rear section 110 of the cradle 100. FIG. 1 also shows a curved stop bar 187 which is formed as a lip adjacent the outer surface of the front load bearing brace 115. The curved stop bar 187 prevents the transportation cask from moving in the forward longitudinal direction. In addition, the trunnions 160 and 165 located at the rear of the cradle prevent the transportation cask from moving in the reverse longitudinal direction.

Figure 2:
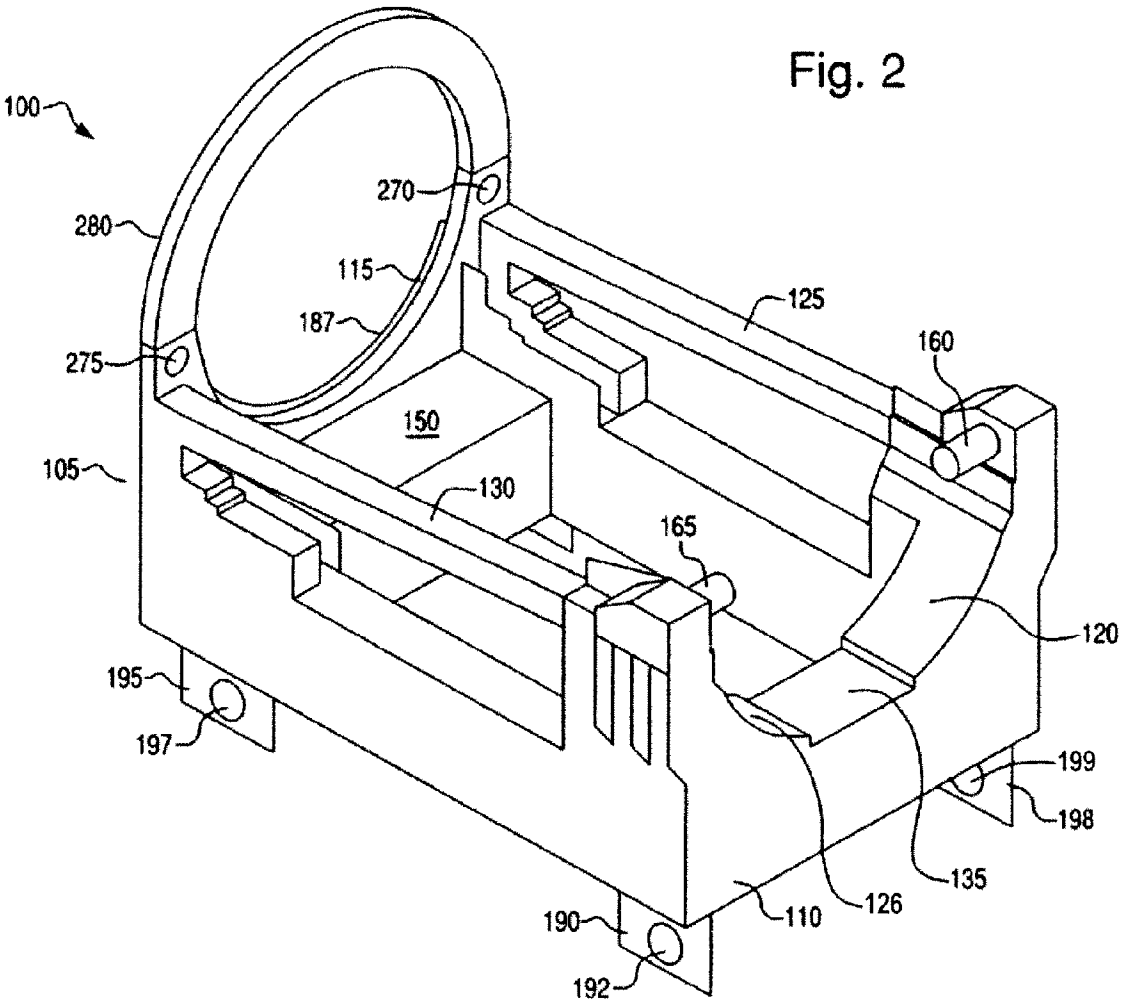
FIG. 2 illustrates a perspective view of the cradle in accordance with an embodiment of the invention.

FIG. 2 shows the cradle apparatus in accordance with the invention. FIG. 2 includes the elements of shown in FIG. 1, but also includes an uplift prevention device 280. The uplift prevention device 280 is mounted onto the cradle 100 via lugs 270 and 275. The lug 270 is located near an upper section at one end of the front load bearing brace 115 and the lug 275 is located near an upper surface at the opposite end of the front load bearing brace 115. The uplift prevention device 280 is put into place after the transportation cask is placed into the cradle 100. The uplift prevention device 280 acts as a retaining element to restrain the transportation cask. Thus, it assists with maintaining the placement of the transportation cask and also prevents upward movement of the transportation cask. The uplift prevention device 280 may be made of any durable material that will effectively restrain the movement of the transportation cask. The material may be rigid or alternatively may be flexible.

Figure 3:
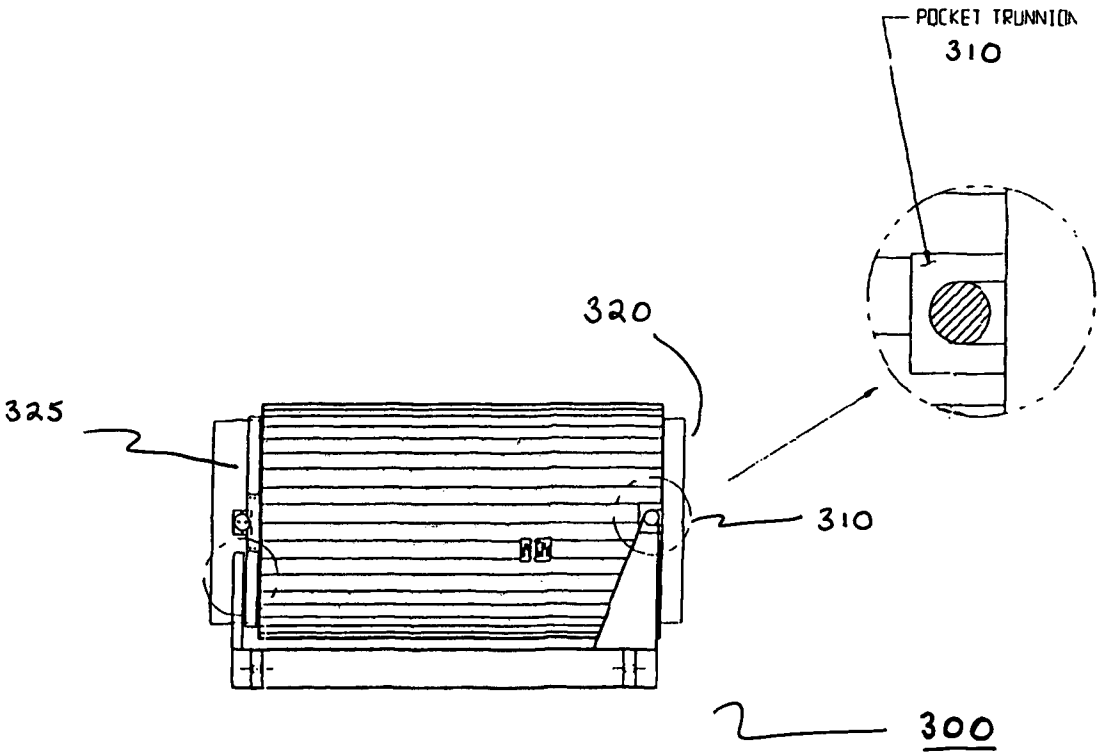
FIG. 3 illustrates a cask including pocket trunnions.

FIG. 3 shows an exemplary transportation cask 300 that may be lowered into the cradle 100. The transportation cask 300 includes two pocket trunnions. A first pocket trunnion 310 is disposed at an end of the transportation cask 300. The second pocket trunnion is not visible in FIG. 3, but is located at the opposite side of the first pocket trunnion 310 so that the first and second pocket trunnions are opposing. The pocket trunnions include notch-like openings that can receive the trunnions 160 and 165 (shown in FIG. 1). In this manner, the transportation cask 300 will be locked into place in the cradle 100. The transportation cask 300 may also include impact absorbers which reduce the transference of shocks to the transportation cask 100 during movement. These impact absorbers may be located at any point on the outer surface of the transportation cask 300. For example, in the embodiment of FIG. 3, impact absorbers 320 and 325 are disposed at the ends of the transportation cask 300.

Figure 4:
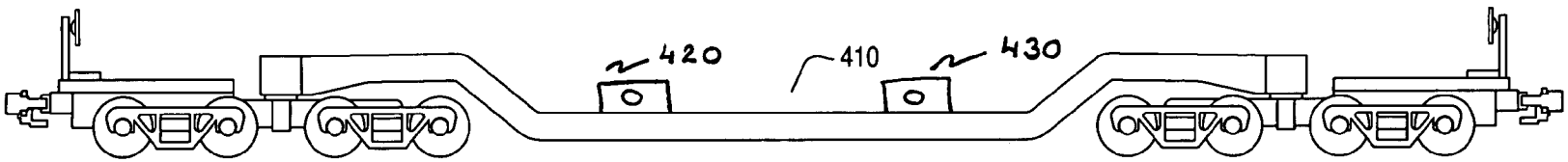
FIG. 4 illustrates a flatbed rail car for receiving the cradle in accordance with the invention.

In accordance with the invention, the cradle 100 is configured so as to be placed on the railcar for transport. FIG. 4 shows a depressed center 410 of a flatbed rail car 400. The cradle 100 (shown in FIGS. 1 and 2) is placed and fitted onto the depressed center 410. The depressed center 410 also has four retaining brackets which couple with the cradle 100 so as to secure the cradle 100 to the flatbed rail car 400. FIG. 4 shows two of the retaining brackets 420 and 430. Two additional retaining brackets (not shown in FIG. 4) are positioned opposing the retaining brackets 420 and 430. The retaining brackets are configured so as to mate with the base members of the cradle 100 via lugs. Thus, the retaining bracket 420 is secured to the base member 195 via lug 197 (shown in FIG. 1) and retaining bracket 430 is secured to base member 190 via lug 192 (shown in FIG. 1).

Thus, the connection between the cradle 100 and depressed center flatbed railcar 420 utilizes round lug pins. The lug pins at the front and rear of the cradle 100 are fixed in the base members located on the bottom surface of the cradle and the retaining bracket. The retaining brackets, when mated to the base members, allows only rotational movement of the cradle 100 at this connection (i.e. no horizontal or vertical movement). The retaining brackets on the railcar at front section of the cradle 100 also only allow rotational movement with no vertical or horizontal movement. However, the retaining brackets on the rear (trunnion end) of the railcar 400 are slotted allowing both rotational and horizontal movement and no vertical movement. This design allows for deflection in the railcar bed camber without applying additional load or stress onto the cradle.

The cradle 100 shown in FIGS. 1 and 2 may be constructed of durable metals such as carbon and alloy steels which provide strength with some flexibility, along with applicable paints and coatings for corrosion resistance. All structural steel plates will be ASTM A514 Grade 100 and the trunnions and trunnion housing plates will be constructed of Inconel 718. The weld electrodes will be AWS 5.5 E11018-X for A514 Grade 100 steel.

The railcar 400 also provides certain features beyond conventional railcars that enhance its safety which is a significant issue when transporting spent nuclear fuel. These features include electronic braking, superior suspension and sway control systems, and a performance monitoring system to allows early detect of degradation in the railcar performance which will identify railcar component degradation prior to component failure. Electronic braking allows for more even braking of the railcars which reduces dynamic loading that can occur with conventional railcar braking. The superior suspension and sway control provides a smoother and less rocking type ride which will limit the total overall swaying movement of the railcar.

The performance monitoring system incorporated into the railcar will provide real time monitoring when operating in the dedicated-train mode. The performance monitoring system collects and stores various data relating to the operation of the railcar. The data will be retrievable both in the passenger car and remotely. The system will produce exception reports when parameters exceed established setpoints. The exception reports will alarm in the passenger car and then be transmitted to the train crew in the engine.

The monitoring system will store time-history data for the parameters monitored. The storage media will be capable of storing the data for continuous operation of the train for 14 days. The media will be retrievable for review and archiving.

The monitoring system in accordance with the invention will include the following:

1. Location Detection—A GPS will be included to identify the location of each of the railcars. The system will be capable of providing real-time, continuous location capabilities and be capable of being monitored locally in the train passenger car and at remote locations. A power supply will be provided that will allow a minimum of thirty (30) days operation without power from the locomotive or other power supply external to the railcar.
2. Speed—The train speed will be monitored both real-time and time-history. The system will allow for train speed monitoring both in the train passenger railcar and at remote locations. This will be accomplished utilizing the GPS and the wheel bearing speed monitor.
3. Odometer—An odometer will be provided on each railcar to log the total distance traveled by the railcar. This will be accomplished utilizing the wheel bearing monitor.
4. Truck Hunting—Lateral movement of the railcar body will be monitored to determine lateral instability. The data will be taken in real-time and recorded as time-history. An alarm will be initiated when the lateral movement has a sustained real-time RMS lateral railcar body acceleration of 0.26 g sustained for 10 seconds. The signal will be transmitted to the train crew. This will be accomplished utilizing accelerometers.
5. Rocking—Side-to-side movement of the railcar body will be monitored to determine the side-to-side roll angles. The data will be taken in real-time and recorded as time-history. An alarm will be initiated when the monitor has a real-time peak-to-peak roll angle of five (5) degrees for three (3) cycles.
6. Wheel Flats—Vertical movement of the wheels will be monitored to determine flat spots on the wheels. The data will be taken in real-time and recorded as time-history. This will be accomplished utilizing accelerometers in the wheel bearings.
7. Bearing Condition—Wheel bearing temperatures will be monitored along with bearing vibrations to determine bearing condition. The data will be taken in real-time and recorded as time-history.
8. Braking Performance—Brake line pressure will be monitored at the auxiliary and emergency reservoirs, and in the air piping to the brake cylinder. The brake cylinder position will also be monitored. The data will be taken in real-time and recorded as time-history.
9. Vertical Acceleration—Vertical movement of the railcar body will be monitored. The data will be taken in real-time and recorded as time-history. An alarm will be initiated for a peak vertical acceleration of the railcar body of 1.0 g. This will be accomplished utilizing accelerometers.
10. Lateral Acceleration—Lateral movement of the railcar body will be monitored. The data will be taken in real-time and recorded as time-history. An alarm will be initiated for a peak lateral acceleration of the railcar body of 0.75 g. This will be accomplished utilizing accelerometers.
11. Longitudinal Acceleration—Longitudinal movement of the railcar body will be monitored. The data will be taken in real-time and recorded as time-history. An alarm will be initiated for a peak lateral acceleration of the railcar body of 1.5 g. This will be accomplished utilizing accelerometers.

Figure 5A:
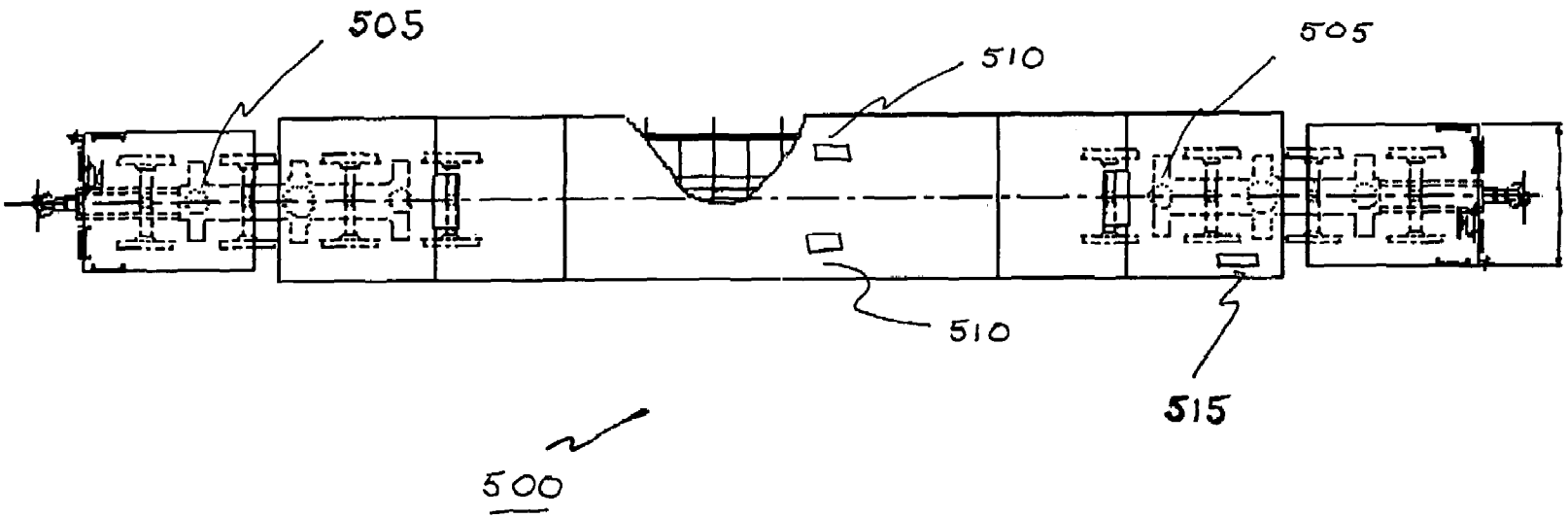
FIG. 5A illustrates a top view of a flatbed rail car with various monitoring components in accordance with an embodiment of the invention.
Figure 5B:
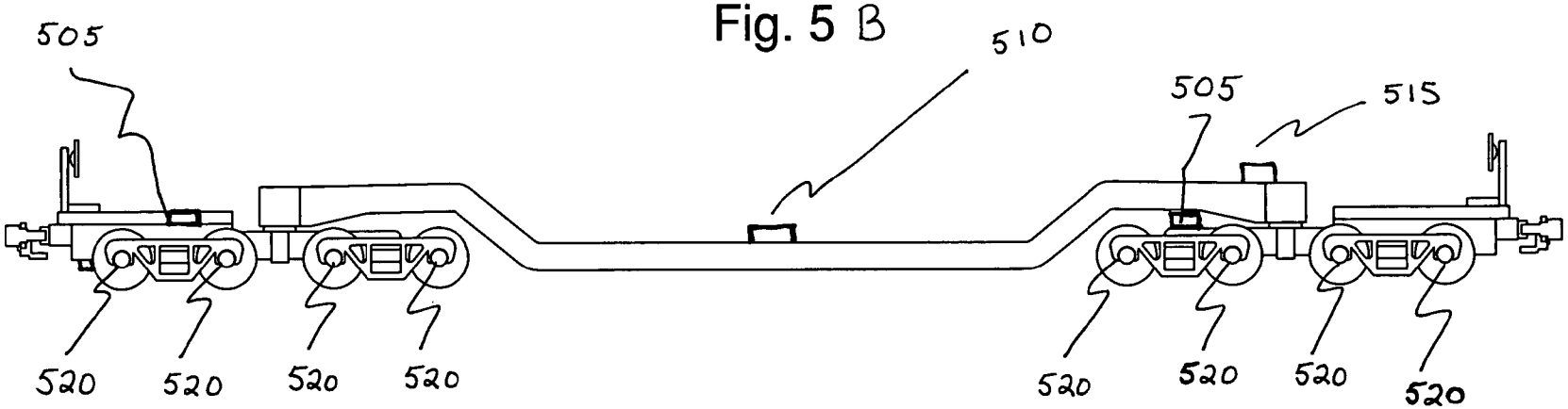
FIG. 5B illustrates a side view of a flatbed rail car with various monitoring components in accordance with an embodiment of the invention

FIGS. 5A and 5B shows the location of the various data gathering components described above. FIG. 5A is a top view of a railcar 500, the railcar having monitoring system in accordance with the invention. FIG. 5A shows that the braking performance sensors 505 are located on a both ends of side of the railcar, while the sensors for truck hunting, rocking and vertical, lateral and longitudinal acceleration 510 are located in the middle section of the railcar, i.e., the depressed center of the railcar. FIG. 5A also shows that a GPS 515 is located near the front section of the railcar. FIG. 5B provides a side view of the railcar which also illustrates the locations of the braking performance sensors 505, the sensors for truck hunting, rocking and vertical, lateral and longitudinal acceleration 510 and the GPS 515. In addition, FIG. 5B also shows a plurality of wheel bearing sensors 520 located at the wheel bearings of each wheel on the railcar. In this manner, multiple parameters impacting the safety of the railcars is monitored.

The foregoing description of the preferred embodiments of the invention has been presented for the purposes of illustration and description. It is not intended to be exhaustive or to limit the invention to the precise form disclosed. Many modifications and variations are possible in light of the above teaching.

The invention claimed is:

1. A transportation cask cradle, comprising:

a front cradle section load bearing brace, the load bearing brace including first and second opposing end portions;

a rear cradle section having a first non-loading bearing brace and a second non-loading brace, the first non-load bearing brace having a first top section and the second non-load bearing brace having a second top section, the first and second top sections opposing each other;

first and second horizontal support members connecting the front cradle section to the rear cradle section; and a first trunnion disposed on the first top section of the first non-load bearing brace and a second trunnion disposed on the second top section of the second non-load bearing brace.

2. The transport cradle according to claim 1, further comprising a nylon bearing surface affixed to the load bearing brace.

3. The transport cradle according to claim 1, further comprising a plurality of base members disposed on a bottom surface of the cradle, the base members allowing the transport cradle to be affixed to a vehicle surface.

4. The transport cradle according to claim 3, wherein the plurality of base members includes at least one lug facilitating affixing the transport cradle to the vehicle surface.

5. The transport cradle according to claim 1, wherein the load bearing brace has a semicircular shape.

6. The transport cradle according to claim 1, further comprising a stop bar affixed to the load bearing brace.

7. The transport cradle according to claim 6, wherein the stop bar prevents a cask from moving in a forward longitudinal direction.

8. The transport cradle according to claim 1, further comprising an uplift prevention device affixed to the first top section of the first non-load bearing brace and the second top section of the second non-load bearing brace.

9. The transportation cradle according to claim 8, wherein the uplift prevention device includes a metal strap and a plastic strap.

10. The transportation cradle according to claim 8, wherein the uplift prevention device is affixed to the first top section of the first non-load bearing brace via a first lug disposed on the surface of the first top section of the first non-load bearing brace and a second lug disposed on the surface of the second top section of the second non-load bearing brace.

11. A railcar for transporting hazardous materials, comprising:

a depressed flatbed disposed on a planar surface of the railcar;

a least one retaining bracket disposed on the depressed flat bed, the at least one retaining bracket configured so as to facilitate coupling with a transportation cradle, the transportation cradle comprising a front cradle section load bearing brace, the load bearing brace including a first and second opposing end portions; a rear cradle section having a first non-loading bearing brace and a second non-loading brace, the first non-load bearing brace having a first top section and the second non-load bearing brace having a second top section, the first and second top sections opposing each other; first and second horizontal support members connecting the front cradle section to the rear cradle section; and a first trunnion disposed on the first top section of the first non-load bearing brace and a second trunnion disposed on the second top section of the second non-load bearing brace.

12. The railcar in accordance with claim 11, further comprising a plurality of wheels disposed along a length of the railcar, the plurality of wheels each having a corresponding wheel bearing assembly.

13. The railcar according to claim 11, further comprising a nylon bearing surface affixed to load bearing brace.

14. The railcar according to claim 11, further comprising a plurality of base members disposed on a bottom surface of the cradle, the base members coupled to the at least one retaining bracket disposed on the depressed flatbed.

15. The railcar according to claim 14, wherein the plurality of base members includes at least one lug facilitating coupling the transport cradle to the depressed flatbed.

16. The railcar according to claim 11, further comprising a stop bar affixed to the load bearing brace.

17. The railcar according to claim 11, further comprising an uplift prevention device affixed to the first top section of the first non-load bearing brace and the second top section of the second non-load bearing brace.

18. The railcar according to claim 11, further comprising braking performance sensors disposed at each end of the railcar, the braking performance sensors gathering data related braking of the railcar.

19. The railcar according to claim 11, further comprising sensors for truck hunting, rocking and vertical, lateral and longitudinal acceleration, the sensors disposed at a middle section of the railcar.

20. The railcar according to claim 11, further comprising a Global Positioning Satellite (GPS) sensor disposed at a front section of the railcar.

21. The railcar according to claim 11, further comprising a plurality of wheel bearing sensors.

* * * * *